US006120349A

United States Patent [19]

Nyui et al.

[11] Patent Number: 6,120,349

[45] Date of Patent: Sep. 19, 2000

[54] POLISHING SYSTEM

[75] Inventors: Masaru Nyui, Utsunomiya; Kazuo Takahashi, Kawasaki, both of Japan

[73] Assignee: Canon Kabushiki Kaisha, Tokyo, Japan

[21] Appl. No.: 08/883,354

[22] Filed: Jun. 26, 1997

[30] Foreign Application Priority Data

Jul. 1, 1996 [JP] Japan ..... 8-190112

[51] Int. Cl.[7] ..... B24B 1/00

[52] U.S. Cl. ..... 451/21; 451/41; 451/6; 451/288; 451/443; 451/494

[58] Field of Search ..... 451/21, 41, 56, 451/285–289, 494, 443, 5, 6, 37, 57

[56] References Cited

U.S. PATENT DOCUMENTS 4,617,469 10/1986 Takahashi et al. .
4,659,225 4/1987 Takahashi .
4,787,749 11/1988 Ban et al. .
4,874,954 10/1989 Takahashi et al. .
5,483,568 1/1996 Yano et al. ..... 451/6
5,618,447 4/1997 Sandhu ..... 451/5
5,655,951 8/1997 Meikle et al. ..... 451/56
5,663,797 9/1997 Sandhu ..... 451/6
5,664,987 9/1997 Renteln ..... 451/21
5,708,506 1/1998 Birang ..... 451/6

*Primary Examiner*—David A. Scherbel
*Assistant Examiner*—George Nguyen
*Attorney, Agent, or Firm*—Fitzpatrick, Cella, Harper & Scinto

[57] ABSTRACT

A polishing system includes a polishing pad for polishing a surface of a layer provided on a substrate, a surface condition measuring device for detecting a condition of a polishing surface of the polishing pad and a controller for controlling a process to the polishing pad by judging whether the polishing pad can be continuously used for polishing of the surface of the layer provided on the substrate, on the basis of a signal indicative of a measurement from the surface condition measuring device.

17 Claims, 5 Drawing Sheets

POLISHING SYSTEM

BACKGROUND OF THE INVENTION

1. Field of the Invention

The present invention relates to a polishing system for flattening the surface of a semiconductor apparatus by mechanical and chemical polishing, adapted for use, for example, in a lithographic process for obtaining semiconductor apparatuses of a high level of integration by flattening the surface of an insulation layer applied on a silicon substrate by effecting the polishing always with a constant polishing rate while monitoring the degree of the polishing surface of the polishing pad used for the polishing operation.

2. Related Background Art

The recent advances in the level of integration of the semiconductor apparatuses have stimulated the progresses toward the finer design of the circuit patterns and toward the three-dimensional structure of the apparatuses. The depth of focus of the projection optical system is reduced as the numerical aperture thereof is increased for realizing the higher level of integration of the semiconductor apparatuses. For this reason, it is important to obtain a high resolution by flattening the surface of the semiconductor apparatus with a polishing operation, thereby eliminating the step difference or the irregularities on the surface, and applying and exposing the photoresist on the thus flattened surface.

The polishing of the insulation layer formed on the silicon substrate for obtaining the layer of a uniform thickness is an important factor for minimizing the fluctuation in the interlayer capacitance and obtaining the through holes of a constant depth.

Mechanical and chemical polishing has conventionally been proposed as the flattening technology for eliminating the surface irregularities and the step differences of the semiconductor apparatuses.

For performing efficient polishing in such mechanical and chemical polishing, it is necessary to adequately control the surface condition (degree) of the polishing surface of the polishing pad, the slurry concentration of the polishing liquid, the temperature of the polished surface, etc. Under unsatisfactory control of these conditions, the desired amount of polishing will not be performed even after passing of the predetermined polishing time, and there may also result a dishing phenomenon or a lining phenomenon due to the difference in the polishing rate between the insulation layer and the electrode wiring portions provided on the silicon substrate, and shortcircuiting between the through holes.

For obtaining a predetermined polishing rate in the mechanical and chemical polishing, it is necessary to maintain the polishing surface of the polishing pad always in satisfactory condition, by dressing the polishing surface, for example, with diamond particles.

In flattening the surface of the semiconductor apparatus by mechanical and chemical polishing, it is important to adequately manage the abrasion state of the polishing surface of the polishing pad, in order to always maintain the predetermined polishing rate.

The polishing pad can be of a type which has a high hardness and a high elasticity recovery rate and is used in the material requiring mechanical polishing such as an oxide film, or another type which has a low hardness and a high elasticity recovery rate and is used in the material requiring chemical polishing such as a polysilicon film, or a type of a two-layered pad structure, composed of the combination of the foregoing two types and having a high hardness and a high elasticity in the face contacting the wafer to be polished.

Because various types of such polishing pads are employed in the mechanical and chemical polishing, it has been extremely difficult to maintain constant surface conditions of the polishing surface of the polishing pad, thereby obtaining a predetermined polishing rate.

Conventionally, the timing of replacement of the polishing pad has been managed in time, in consideration of the frequency of use thereof. For this reason, the decrease of the polishing rate cannot be adequately judged promptly and there inevitably results a loss in the throughput.

SUMMARY OF THE INVENTION

In consideration of the foregoing, the object of the present invention is to provide a polishing system suitable for the manufacture of the semiconductor apparatuses of a high level of integration, in flattening the surface of the semiconductor apparatuses by mechanical and chemical polishing, by measuring the surface condition of the polishing surface of the polishing pad to adequately judge the timing of dressing and replacement of the polishing pad, thereby always performing a constant polishing rate and enabling efficient flattening of the surface of the semiconductor apparatuses.

The foregoing object can be attained, according to an aspect of the present invention, by a polishing system comprising:

- polishing means for relatively driving, the surface of a layer provided on a substrate to a polishing pad;
- surface condition measuring means for detecting the surface condition of the polishing surface of the polishing pad; and
- control means for controlling the process for the polishing pad, based on a signal from the surface condition measuring means.

There may also be provided dressing means for dressing the polishing pad, based on a dressing signal for the polishing pad from the control means.

There may also be provided automatic changing means for automatically changing the polishing pad, based on a change signal for the polishing pad from the control means.

The surface condition measuring means includes a casing for immersing the polishing pad in purified water.

The surface condition measuring means includes circulating means for circulating the purified water in the above-mentioned casing, thereby increasing the transparency of the purified water.

The surface condition measuring means includes reflectivity measuring means for measuring the reflectivity of the polishing surface of a polishing pad immersed in the purified water in the above-mentioned casing, through a transparent glass member provided in the casing.

The reflectivity measuring means includes a measuring unit for receiving, the light from the polishing surface with a photosensor element, when the light from a light source is incident on the polishing surface of the polishing pad.

The reflectivity measuring means includes an auto focusing system for relative alignment of the measuring unit and the face of the polishing pad.

Also, there may be provided plural measuring units for detecting the surface condition in plural positions on the polishing surface of the polishing pad.

The control means includes a signal processing unit for investigating the surface condition of the polishing surface, by comparing the signal from the surface condition measuring means with a predetermined value.

The signal processing unit is adapted to detect the degree of the polishing surface of the polishing pad.

There is also provided a judging unit adapted, in case a signal indicating a high degree of the polishing surface is obtained from the signal processing unit, to judge whether the polishing surface has already been dressed, and, if not dressed, to output a signal for executing the dressing process but, if already dressed, to perform a change signal for changing the polishing pad.

The polishing means includes plural polishing means for polishing a part of the surface of the aforementioned layer.

The polishing system may also comprise a monitor unit array for detecting the surface information at plural positions on the aforementioned layer thereby obtaining the surface form thereof, or detecting the thickness in plural positions of the layer thereby obtaining the thickness distribution thereof.

According to another aspect of the present invention, there is provided a surface condition detecting apparatus for measuring the surface condition of the polishing pad for polishing the surface of a work piece, comprising:

a casing for immersing the polishing pad in purified water;

circulating means for circulating the purified water in the casing; and measuring means for measuring the surface condition of the polishing pad, immersed in the purified water in the casing, through a transparent glass member provided in the casing.

The measuring means includes reflectivity measuring means for measuring the reflectivity of the polishing surface.

The present invention will be clarified in more detail by embodiments to be described in the following.

DETAILED DESCRIPTION OF THE PREFERRED EMBODIMENTS

Figure 1:
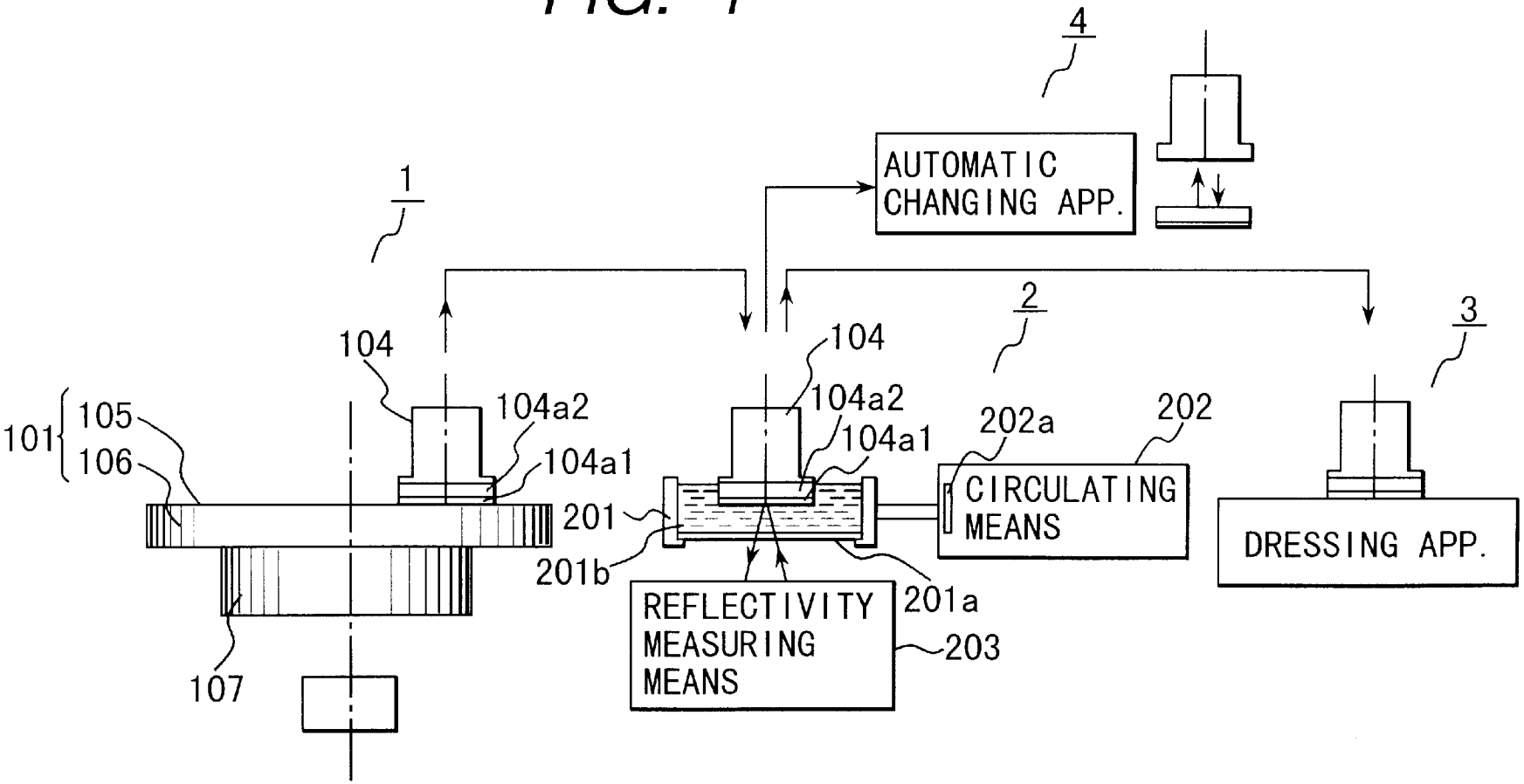
FIG. 1 is a schematic view of a first embodiment of the present invention.
Figure 2:
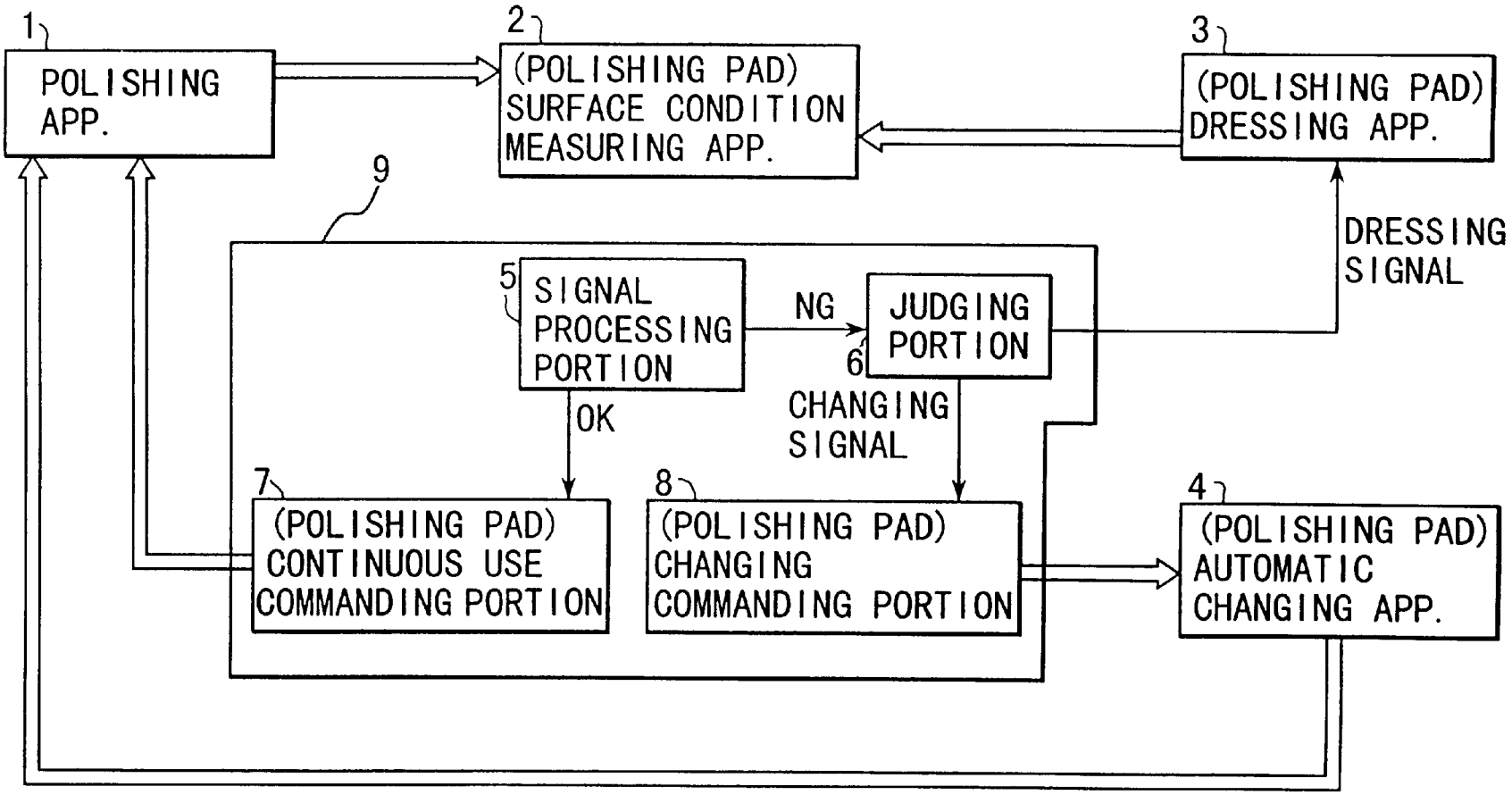
FIG. 2 is a schematic block diagram of the first embodiment.

FIGS. 1 and 2 are respectively a schematic view and a schematic block diagram of a first embodiment of the polishing system of the present invention, wherein shown is a mechanical and chemical polishing apparatus 1 which partially executes mechanical and chemical polishing of an insulation layer 105 on a silicon substrate 106, by means of a partial polishing tool 104 constituting polishing means. There are provided plural units of the partial polishing tools 104, for partially polishing the work piece 101. A casing 201 has a bottom composed of a transparent glass member 201*a*, and is generally filled with purified water 201*b*.

A surface condition measuring apparatus 2 is provided for measuring the surface condition of the polishing surface of the polishing pad 104*a*1. More specifically, the condition of abrasion of the polishing surface is detected by measuring the amount of reflected light (scattered light) from the polishing surface to obtain the reflectivity. A control apparatus 9 shown in FIG. 2 is provided with a signal processing portion 5, a judging portion 6, a continuous use commanding portion 7, a changing commanding portion 8, etc., to be explained later.

A dressing apparatus 3 executes elimination of slurry contained in the fibers of the polishing surface of the polishing pad 104*a*1 and adjustment of surface irregularities thereof, based on a signal from the control apparatus 9. An automatic changing apparatus 4 executes automatic changing of the polishing pad 104*a*1 and a polishing pad holder 104*a*2, based on the signal from the control apparatus 9.

In general, with the progress of polishing of the work piece 101 with the partial polishing tools 104 of the polishing apparatus 1, the polishing surface of the polishing pad 104*a*1 becomes abraded and the polishing rate (amount of polishing per unit time) becomes lower.

In the present embodiment, therefore, the control apparatus 9 detects the degree of the polishing surface and the polishing pad is changed according to necessity. First, in the present embodiment, after the polishing for a predetermined time or after the polishing of a predetermined number of work pieces, the degree of the polishing pad is obtained by the surface condition measuring apparatus 2. The obtaining of the degree is performed by detecting the reflectivity of the polishing surface of the polishing pad, or the amount of reflected light (scattered light) from the polishing surface.

The measurement is made on plural positions on the polishing surface, by the same measuring unit or by plural measuring units. When the polishing surface becomes abraded, it generally loses surface coarseness and becomes smoother, namely becomes a substantial mirror surface so that the reflectivity becomes higher (amount of scattered light becomes less).

The partial polishing tool 104 is retracted from the work piece 101 and is moved onto the surface condition measuring apparatus 2. Then, the surface condition measuring apparatus 2 measures the reflectivity of the polishing pad, and the signal processing portion 5 compares the result of measurement with a predetermined value.

If the signal processing portion 5 identifies that the reflectivity of the polishing surface of the polishing pad is less than the predetermined value, indicating that the degree of the polishing surface is still low and that the predetermined polishing rate can still be obtained, it inputs an OK signal into the continuous use commanding portion 7, which in response does not change the polishing pad but moves the partial polishing tool 104 onto the work piece 101 to continue the polishing operation.

On the other hand, if the signal processing portion 5 identifies that the reflectivity of the polishing surface of the polishing pad is larger than the predetermined value, indicating a high degree of the polishing surface, it inputs an NG signal into the judgement portion 6, which in response judges whether the polishing pad has already been dressed in the dressing apparatus 3 or not.

If the polishing pad has not been dressed in the dressing apparatus 3, a dressing signal is inputted into the dressing apparatus 3, which in response executes dressing of the polishing surface. The polishing pad subjected to dressing in the dressing apparatus 3 is again subjected to the measurement of reflectivity of the polishing surface in the surface condition measuring apparatus 2.

On the other hand, if the judgment portion 6 judges that dressing of the polishing surface has already been performed, the dressing operation again will not provide the predetermined polishing rate and a change signal for the polishing pad is inputted into the change commanding portion 8, which in response executes automatic changing of the polishing pad, together with the polishing pad holder 104*a*2, for example, by an on-off operation of a solenoid. The polishing pad 104*a*1 is fixed to the holder 104*a*2, for example, with an adhesive tape or a fixing material. The partial polishing tool 104, subjected to the automatic changing of the polishing pad, is moved onto the work piece 101 and the polishing operation is continued.

In the present embodiment, as explained in the foregoing, automatic control for conducting the polishing operation with a constant polishing rate is always performed by monitoring the degree of abrasion of the polishing surface of the polishing pad, by detecting the surface condition of the polishing surface.

Figure 3:
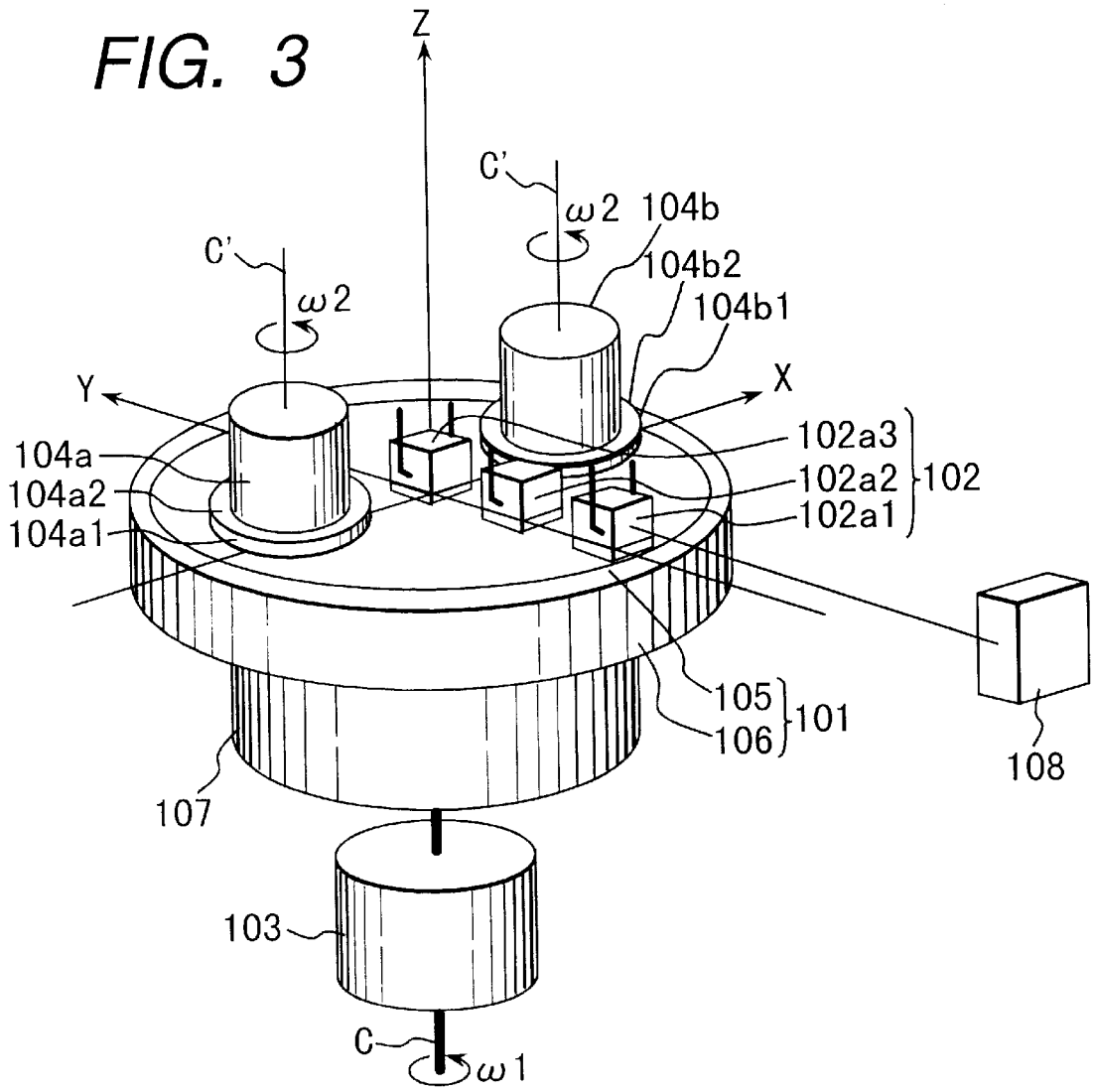
FIG. 3 is a schematic view of the polishing apparatus shown in FIG. 1.

In the following, there will be explained a more detailed configuration of the components shown in FIG. 1. FIG. 3 is a schematic view of the polishing apparatus shown in FIG. 1. In FIG. 3, the work piece 101 is composed of an insulation layer 105 formed on a silicon substrate 106, and is supported by a substrate holder 107.

In the present embodiment, the insulation layer 105 on the silicon substrate 106 is subjected to partial mechanical and chemical polishing by plural partial polishing tools (polishing means) 104. The substrate holder 107, supporting the work piece 101, is rotated about a rotary axis C, with an angular velocity ω 1, by drive means (not shown). In FIG. 3, the rotary axis C is taken as the Z-axis, and a plane perpendicular thereto is taken as the XY-plane.

Partial polishing tools 104*a*, 104*b* are respectively provided with polishing pads 104*a*1, 104*b*1 and polishing pad holders 104*a*2, 104*b*2, and are rotated about a rotary axis C', with an angular velocity ω 2, by drive means (not shown). Thus, FIG. 3 shows a case of partially polishing the insulation layer 105 on the silicon substrate 106 with two polishing pads 104*a*, 104*b*. However, there may be provided two or more partial polishing tools.

In the present embodiment, the polishing aperture of the polishing pads 104*a*1, 104*b*1 is selected to be smaller than the polished surface (insulation film) 105 of the work piece 101, in order to perform partial polishing. An encoder 103 detects the rotational information of the rotary axis C. A monitor unit array 102 is provided, as shown in FIG. 3, with a one-dimensional array of plural sensors 102*a*1–102*a*3 along the Y-axis, and measures, by these sensors, the surface condition such as the surface shape or the film thickness distribution of the insulation layer 105 on the silicon substrate 106.

In the present embodiment, the polishing of the surface of the insulation layer 105 is performed under rotation of the partial polishing tool 104 about the rotary axis C' and rotation of the substrate holder 107 about the rotary axis C, namely under mutually relative movement of the two, combined with a variation in the relative position of the two in the X and Y directions, if necessary, and under the supply of slurry containing polishing material from a nozzle (not shown) onto the work piece 101, resulting in the interface supplying the slurry between the insulation layer 105 and the polishing pads 104*a*1, 104*b*1.

The polishing operation is conducted with a suitable selection of the pressure between the insulation layer 105 and the partial polishing tools 104, the ratio of revolutions thereof and the amount of supply of the slurry. In this manner, the insulation layer 105 formed on the silicon substrate 106 is flattened by partial polishing with the partial polishing tools 104.

In the present embodiment, as shown in FIG. 3, the sensor unit array 102 is positioned in an area where the polishing operation of the partial polishing tools 4*a*, 4*b* is not hindered, thereby enabling the obtainment of the surface condition in plural positions of the work piece 101, at an arbitrary time in the course of the polishing operation.

In particular, the film thickness and the surface shape of the insulation layer 105 on the silicon substrate 106 are simultaneously measured, in plural positions, by the monitor unit array 102 while the work piece 101 is being rotated. In this manner, the information on the film thickness can be obtained efficiently over a wide area of the insulation layer 105.

Based on the output signal from the monitor unit array 102, the control means 108 obtains the surface condition, such as the surface shape and the film thickness distribution, of the entire insulation layer 105. The control means 108 also judges whether both the surface shape, such as the surface irregularities or the step difference, and the film thickness distribution are within predetermined ranges, and, if both are within the predetermined ranges, the polishing operation is identified to have reached the end point and the polishing process is terminated. If otherwise, the polishing operation is continued.

On the other hand, the control means 108 terminates the polishing process if it is judged that both the surface shape and the film thickness distribution of the insulation layer 105 are not contained in the predetermined ranges (for example, in case the film has become too thin because of excessive polishing). In such a case the work piece 101 is judged as being a defective product.

In the present embodiment, as explained in the foregoing, the insulation layer 105 of the silicon substrate 106 is so flattened whereby, at the subsequent projection exposure, the entire desired area of the insulation layer 105 is contained within the depth of focus of the projection optical system. Also, the thickness of the insulation layer 105 is controlled within a predetermined range, in order to prevent fluctuation in the interlayer capacitance and to obtain through holes of a uniform depth.

There is also provided an effect of obtaining the end point of the polishing process more exactly and more promptly, by measuring the surface condition of the work piece 101 in the course of the polishing operation.

Referring to FIG. 3, it is also possible to move supporting portions (101, 107, 103, etc.) of the polishing apparatus 1 in the X-direction after the surface polishing of the work piece 101, then to detect the surface information (surface shape and film thickness distribution) of the work piece 101 with the monitor unit array provided in a predetermined fixed position, and to cause the control means to terminate or continue the polishing process of the work piece 101 based on the result of the detection by the monitor unit array.

In the following, there will be given an explanation of the surface condition measuring apparatus 2 shown in FIG. 1. The surface condition measuring apparatus 2 of the present embodiment is provided with a casing 201 containing purified water in which the polishing pad 104*a*1 of the partial polishing tool 104 is to be immersed, a circulating apparatus 202 incorporating a filter 202*a* for increasing the transparency of the purified (distilled) water at the measurement of the surface condition of the polishing surface, and a reflectivity measuring means 203 for measuring the polishing surface of the polishing pad 104*a*1 through the transparent glass member 201*a*.

FIG. 1 is a schematic view showing the method of measurement (for example, by the amount of scattered light) of the surface condition of the polishing surface 104*a*3 of the polishing pad 104*a*1 by means of the reflectivity measuring means 203. The polishing pad 104*a*1, when not used, is immersed in purified water 201*b* as shown in FIG. 1, in order to avoid drying or fixation of the slurry deposited thereon. Also, the measurement of the surface condition of the polishing surface is made through the transparent glass member 201*a* and the purified water 201*b*.

Figure 4:
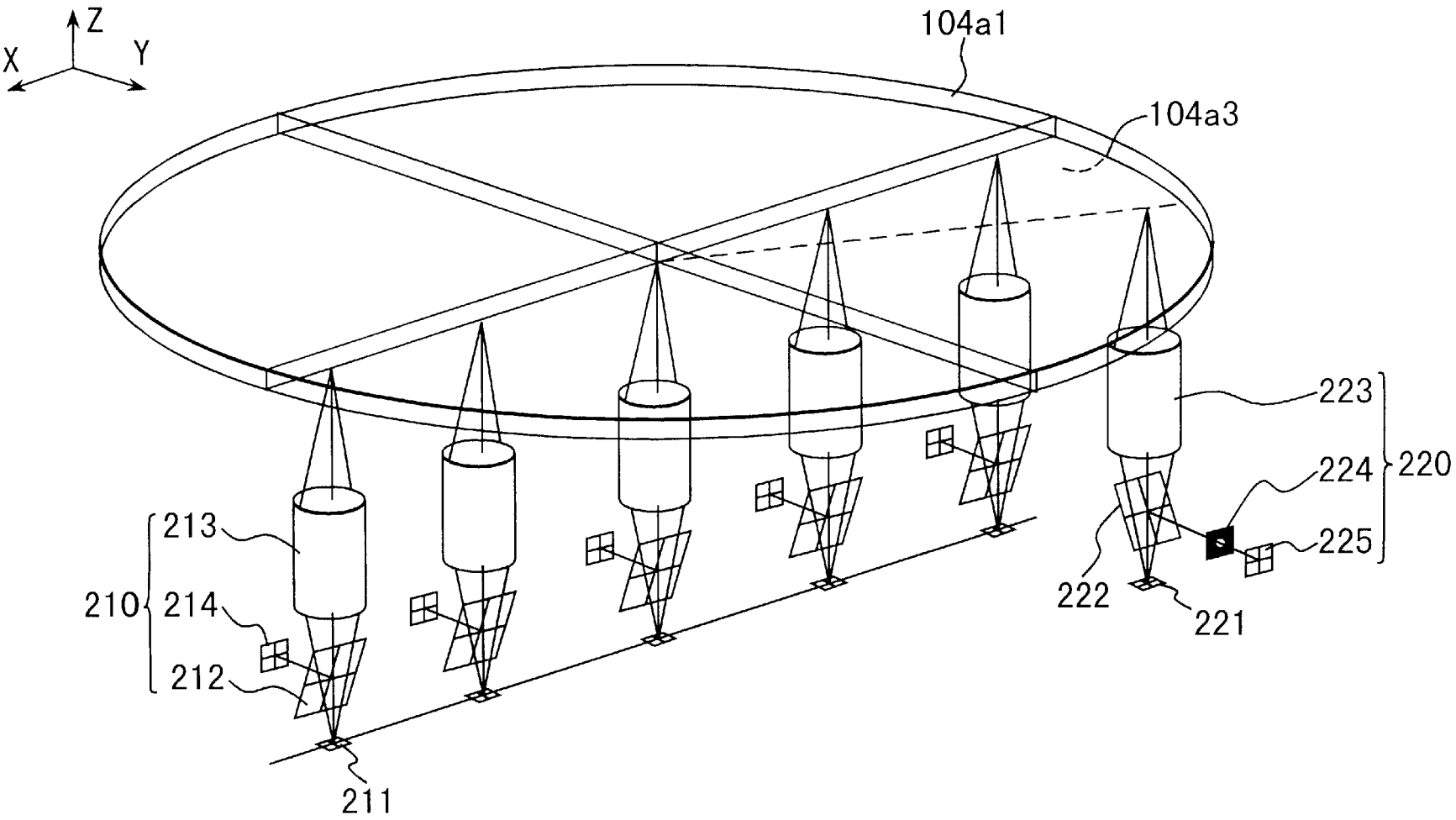
FIG. 4 is a schematic view of the reflectivity measuring means shown in FIG. 1.

Referring to FIG. 4, a measuring unit 210 measures the reflectivity of an area of the polishing surface 104*a*3 of the polishing pad 104*a*1. In FIG. 4, the transparent glass member 201*a* and the purified water 201*b* shown in FIG. 1 are omitted from illustration. The measuring unit 201 is provided the plural units (5 units in the case of FIG. 4), for obtaining the reflectivity in plural positions of the polishing surface 104*a*3. If necessary, the surface condition of the polishing pad 104*a*1 may be measured two-dimensionally, by varying the relative position of the polishing pad 104*a*1 and the plural measuring units.

An automatic focusing system 220 detects the positional information of the polishing surface 104*a*3 of the polishing pad 104*a*1 (for example, the distance from a predetermined plane of the measuring unit 210 to the polishing surface 104*a*3). Based on the signal from the automatic focusing system 220, the position of the measuring unit 210 in the direction of the optical axis (Z-direction) is adjusted by drive means (not shown), so that the measuring operation of the measuring unit can always become constant.

In the measuring unit 210, among the light from a light source 211, a light beam transmitted through a half mirror 212 is condensed by a lens 213 onto the polishing surface 104*a*3, and the light reflected therefrom is condensed by the lens 213, then reflected by the half mirror 212 and received by a photosensor element 214. The degree of abrasion of the polishing surface 104*a*3 is detected by obtaining the reflectivity from the amount of reflected light (or scattered light) received by the photosensor element 214.

In the automatic focusing system 220, among the light from light source 221, a light beam transmitted through a half mirror 222 is condensed by a lens 223 onto the polishing surface 104*a*3, and the light reflected therefrom is condensed by the lens 223, then reflected by the half mirror 222 and is detected by a photosensor element 225 through a pinhole 224.

The components are so designed that the amount of light passing through the pinhole 224 becomes largest when the light beam is focused smallest on the polishing surface 104*a*3 by the lens 223, and there is thus obtained the information of the distance between the lens 223 and the polishing surface 104*a*3.

In the present embodiment, the automatic focusing system 220 may be applied to a system based on another auto focusing method.

Figure 5:
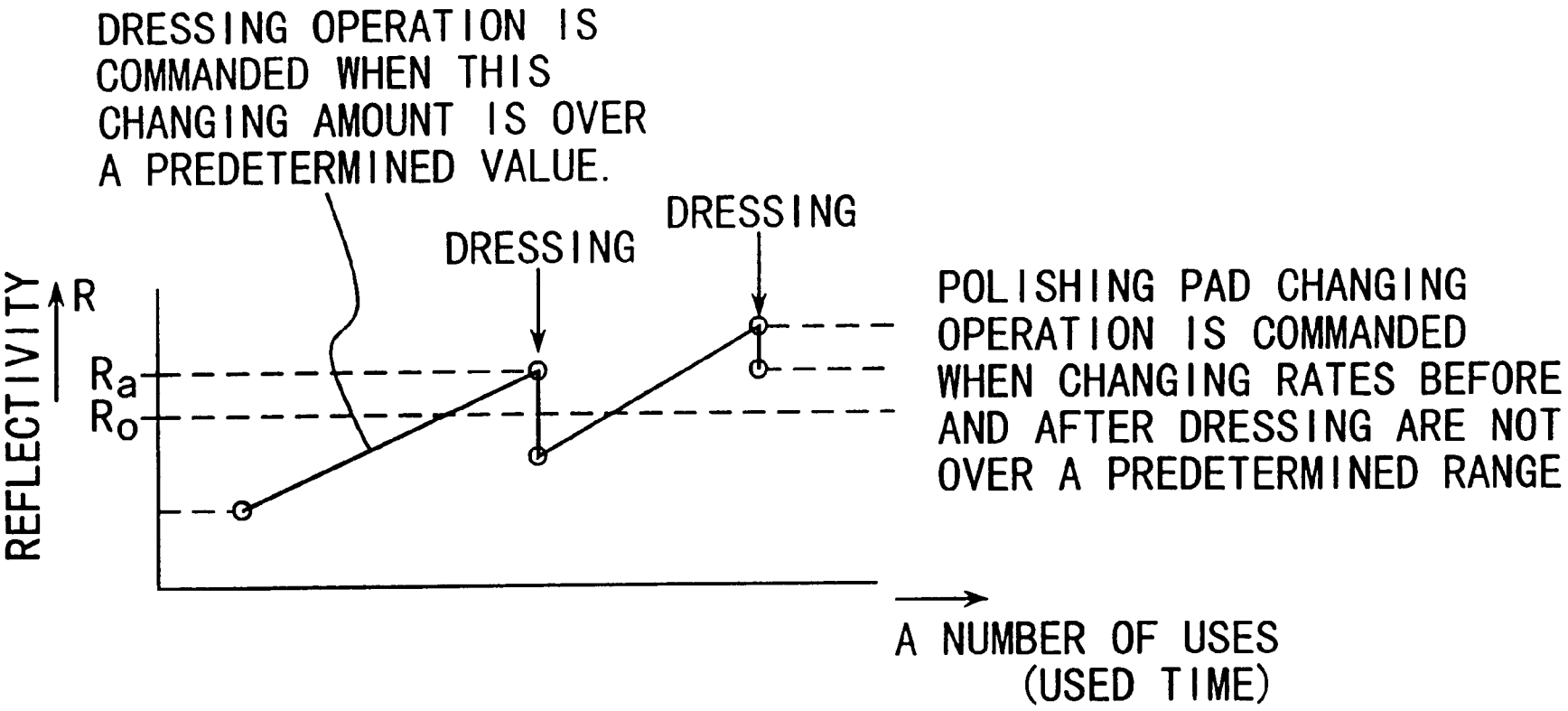
FIG. 5 is a chart showing the data processing in the signal processing unit in FIG. 2.

FIG. 5 is a chart showing the signal processing in the signal processing portion 5, constituting the control apparatus 9, for judging whether or not to change the polishing pad based on the data of the reflectivity (amount of reflected light) from the surface condition measuring apparatus 2.

In FIG. 5, the abscissa indicates the number of uses or the time of use of the polishing pad, while the ordinate indicates the reflectivity (amount of reflected light) of the polishing surface. With the increase in the number or uses (or in the time of use), the polishing pad loses the coarseness of the polishing surface, thus becoming smoother, namely a substantial mirror surface. As a result, the reflectivity of the polishing surface increases, or, the amount of scattered light decreases.

In the present embodiment, the reflectivity of the polishing surface is measured after a predetermined number of uses or after a predetermined time of use of the polishing pad, and, when the reflectivity of the polishing surface becomes higher than a predetermined value Ra, the polishing surface is judged as being abraded whereby dressing is performed.

After the dressing operation, the reflectivity of the polishing surface is measured again, and, if it becomes smaller than a predetermined value Ro, the polishing operation is continued as the predetermined polishing rate can be obtained. On the other hand, if the reflectivity of the polishing surface after the dressing operation is larger than the predetermined value Ro, the polishing pad is changed after it is judged that the predetermined polishing rate cannot be obtained.

As explained in the foregoing, the present embodiment enables a polishing operation always with a constant polishing rate, by measuring the reflectivity of the polishing surface of the polishing pad, then effecting the dressing operation according to the result of the measurement, again measuring the reflectivity of the polishing surface after the dressing and continuing the polishing operation or changing the polishing pad based on the result of such remeasurement.

What is claimed is:

1. A polishing system comprising:

a plurality of polishing pads for polishing portions of a surface of a layer provided on a substrate;

surface condition measuring means for detecting a condition of a polishing surface of said polishing pad; and control means for controlling a process to said polishing pad by judging whether said polishing pad can be continuously used for polishing of the surface of the layer provided on the substrate, on the basis of a signal indicative of a measurement from said surface condition measuring means.

2. A polishing system comprising:

a polishing pad for polishing a surface of a layer provided on a substrate;

surface condition measuring means for measuring a condition of a polishing surface of said polishing pad, said surface condition measuring means including a casing for immersing said polishing pad in purified water; and control means for controlling a process to said polishing pad on the basis of a signal indicative of measurement from said surface condition measuring means.

3. A polishing system according to claim 2, wherein said surface condition measuring means includes circulating means for circulating the purified water in said casing thereby increasing the transparency of said purified water.

4. A polishing system according to claim 3, wherein said surface condition measuring means includes reflectivity measuring means for measuring the reflectivity of the polishing surface of the polishing pad immersed in the purified water in said casing, through a transparent glass member provided in said casing.

5. A polishing system according to claim 4, wherein said reflectivity measuring means includes a measuring unit for receiving, by a photosensor element, the light reflected from said polishing surface of said polishing pad when the light from a light source is incident on said polishing surface.

6. A polishing system according to claim 4, wherein said reflectivity measuring means includes an automatic focusing system for relative alignment of said measuring unit and the polishing surface of the polishing pad.

7. A polishing system according to claim 6, wherein said measuring unit is provided in plural units for measuring the surface condition of the polishing surface of said polishing pad in plural positions.

8. A polishing system according to claim 2, wherein said control means includes a signal processing unit for examining the surface condition of said polishing surface, by comparing the signal from said surface condition measuring means with a predetermined value.

9. A polishing system according to claim 8, wherein said signal processing unit detects the degree of abrasion of the polishing surface of said polishing pad.

10. A polishing system comprising:

a polishing pad for polishing a surface of a layer provided on a substrate;

surface condition measuring means for measuring a condition of a polishing surface of said polishing pad; and control means for controlling a process to said polishing pad on the basis of a measurement value of said surface condition measuring means, said control means including judging means for judging a degree of abrasion of said polishing surface of said polishing pad by comparing said measurement value of said surface condition measuring means with a predetermined setting value, wherein said judging means judges whether the polishing surface of said polishing pad has already been subjected to a dressing process in a case of a high degree of abrasion of the polishing surface of said polishing pad, said judging means outputs a signal for executing the dressing process to the polishing surface of said polishing pad when it is judged that the polishing surface of said polishing pad has not been subjected to the dressing process yet, and said judging means outputs a signal for changing said polishing pad when it is judged that the polishing surface of said polishing pad has already been subjected to the dressing process.

11. A polishing system comprising:

a polishing pad for polishing a surface of a layer provided on a substrate;

surface condition measuring means for detecting a condition of a polishing surface of said polishing pad;

control means for controlling a process to said polishing pad by judging whether said polishing pad can be continuously used for polishing of the surface of the layer provided on the substrate, on the basis of a signal indicative of a measurement from said surface condition measuring means; and a monitor unit array for detecting one of (i) the surface information of said layer at plural positions thereof, thereby detecting the surface shape of said layer and (ii) the thickness of said layer in plural positions thereof, thereby obtaining the thickness distribution of said layer.

12. A surface condition detecting apparatus for measuring the surface condition of a polishing pad for polishing the surface of a work piece, comprising:

a casing for immersing said polishing pad in purified water;

circulating means for circulating the purified water in said casing; and measuring means for measuring the surface condition of the polishing surface of said polishing pad immersed in the purified water of said casing through a transparent glass member provided in said casing.

13. An apparatus according to claim 12, wherein said measuring means includes reflectivity measuring means for measuring the reflectivity of said polishing surface.

14. A polishing system comprising:

a polishing pad for polishing a surface of a layer provided on a substrate;

detection means for detecting a condition of a polishing surface of said polishing pad, said detecting means comprising a casing for immersing said polishing pad in purified water; and judging means for judging whether said polishing pad can be continuously used for polishing the surface of the layer provided on the substrate, on the basis of a detection signal from said detection means.

15. A polishing system according to claim 14, further comprising dressing means for executing a dressing process to said polishing pad, wherein said dressing means executes the dressing process to said polishing pad after said judging means has judged that said polishing pad cannot be continuously used.

16. A polishing system according to claim 15, further comprising pad changing means for changing said polishing pad, wherein said pad changing means executes a change of said polishing pad after said judging means has judged that said polishing pad cannot be continuously used and said polishing pad has already been subject to the dressing process.

17. A polishing system comprising:

a polishing pad for polishing a surface of a layer provided on a substrate;

detection means for detecting a condition of a polishing surface of said polishing pad; and judging means for judging a degree of abrasion of said polishing surface of said polishing pad by comparing the detection value of said detection means with a predetermined setting value, wherein said judging means judges whether the polishing surface of said polishing pad has already been subjected to a dressing process in a case of a high degree of abrasion of the polishing surface of said polishing pad, said judging means outputs a signal for executing the dressing process to said polishing surface of said polishing pad when it is judged that the polishing surface of said polishing pad has not been subjected to the dressing process yet, and said judging means outputs a signal for changing the polishing pad when it is judged that the polishing surface of said polishing pad has already been subjected to the dressing process.

* * * * *

UNITED STATES PATENT AND TRADEMARK OFFICE

CERTIFICATE OF CORRECTION

PATENT NO. : 6,120,349

DATED : September 19, 2000

INVENTOR(S) : MASARU NYUI, ET AL.

It is certified that error appears in the above-identified patent and that said Letters Patent is hereby corrected as shown below:

COLUMN 2:

Line 57, "receiving, the" should read --receiving--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*